US011673705B2

(12) United States Patent
De Smet

(10) Patent No.: US 11,673,705 B2
(45) Date of Patent: Jun. 13, 2023

(54) METAL BOTTLE CAN COMPRISING A CURL PORTION FOR RECEIVING A CROWN TYPE CLOSURE

(71) Applicant: ANHEUSER-BUSCH INBEV S.A., Brussels (BE)

(72) Inventor: Jan De Smet, Leuven (BE)

(73) Assignee: Anheuser-Busch Inbev S.A., Brussels (BE)

( * ) Notice: Subject to any disclaimer, the term of this patent is extended or adjusted under 35 U.S.C. 154(b) by 195 days.

(21) Appl. No.: 17/273,759

(22) PCT Filed: Sep. 6, 2019

(86) PCT No.: PCT/EP2019/073809
§ 371 (c)(1),
(2) Date: Mar. 5, 2021

(87) PCT Pub. No.: WO2020/049145
PCT Pub. Date: Mar. 12, 2020

(65) Prior Publication Data

US 2021/0347517 A1 Nov. 11, 2021

(30) Foreign Application Priority Data

Sep. 6, 2018 (BE) ..... 2018/5615

(51) Int. Cl.
*B65D 1/02* (2006.01)
*B65D 41/12* (2006.01)

(52) U.S. Cl.
CPC ..... *B65D 1/0246* (2013.01); *B65D 41/125* (2013.01)

(58) Field of Classification Search
CPC .. B65D 1/0246; B65D 14/023; B65D 1/0223; B65D 41/125; B65D 41/12; B65D 41/10;
(Continued)

(56) References Cited

U.S. PATENT DOCUMENTS 2,339,763 A * 1/1944 Calleson ..... B21D 51/2615 220/604
8,360,266 B2 1/2013 Adams et al.

FOREIGN PATENT DOCUMENTS

CN 102874449 A 1/2013
WO 2011/058207 A2 5/2011

OTHER PUBLICATIONS

International Search Report and Written Opinion for Application No. PCT/EP2019/073809 dated Dec. 9, 2019 (9 pages).

* cited by examiner

*Primary Examiner* — Robert J Hicks
(74) *Attorney, Agent, or Firm* — Michael Best & Friedrich LLP

(57) ABSTRACT

A metal bottle-shaped container comprising a neck portion (5) defining an opening to the container, the neck portion extending into a neck finish (6) configured to receive a crown closure for sealing the opening, the neck finish comprising three distinct sections, a proximal section (6.P) extending from the neck portion of the container and connected thereto by a first bend (6.1), a distal section (6.D) comprising the free end of the neck finish and an intermediate section (6.1) extending between the proximal section and the distal section and connected thereto by respectively a second bend (6.2) and a third bend (6.3), characterized in that the proximal section is substantially planar and has a width of at least 0.5 mm measured between the first and second bends.

14 Claims, 2 Drawing Sheets

(58) Field of Classification Search
CPC ... B21D 51/263; B21D 51/2638; B21D 51/38
USPC ..... 215/45, 43, 328, 324, 316; 220/310.1, 220/309.1; 413/11, 8; 72/379.4
See application file for complete search history.

METAL BOTTLE CAN COMPRISING A CURL PORTION FOR RECEIVING A CROWN TYPE CLOSURE

FIELD OF THE INVENTION

The present invention concerns a metal bottle-shaped container of the type comprising a neck portion defining an opening to the container, the neck portion extending into a neck finish configured to receive a crown closure for sealing the opening.

BACKGROUND FOR THE INVENTION

Glass bottles have been crowned for over 100 years and the basic principle has not been changed. The process was optimized for glass bottles and specifically applies high vertical loads for pressing the crown closure on the glass bottle to cover for height differences between bottles inherent part of glass bottle production. Glass bottle interfaces with the crown closure have a smooth finish to avoid breakage, cracks and production issues in the glass bottle.

With the introduction of metal, in particular aluminium bottles the industry adopted crown closures, working loads and neck finish designs inherited from glass packaging. Prior art and commercial samples demonstrate that smooth & round finishes are used for sealing.

In the more recent past new technologies have been introduced to reduce the amount of aluminium used in bottles. Coil-to-can (C2C) technology to produce aluminium cans has been adapted to allow aluminium bottle production with much thinner side-walls making the packaging material more cost-competitive. This did however reduce the axial load resistance of the bottles and blocked the usage of crown closures on C2C bottles. Current C2C bottles no longer sustain the high loads required to crimp a crown closure on the bottle.

Developments can be found in prior art to optimize the application process of crown closures for lightweighted aluminium bottles (eg. CN102874449, U.S. Pat. No. 8,360,266), the latter wherein the neck portion of the bottles is provided with an outwardly extending ring allowing supporting the bottles during application of a crown closure, without applying a load on a shoulder portion of these bottles. Providing such outwardly extending ring however limits bottle design, especially for bottles designed to have a premium experience and look for customers.

It is clear that based on the state of art, there remains a market need for metal bottle-shaped containers and in particular the so-called lightweight metal bottle-shaped containers suitable for sealing with crown closures without unnecessarily limiting design freedom of the bottles.

SUMMARY OF THE INVENTION

The present invention addresses the above market need by providing a metal bottle-shaped container having a specific neck finish designed to allow sealing the container with a crown closure under application of a limited vertical load, thereby reducing the vertical load resistance requirements of the bottle.

In order to achieve this goal, the present invention concerns a metal bottle-shaped container comprising a neck portion defining an opening to the container, the neck portion extending into a neck finish configured to receive a crown closure for sealing the opening, the neck finish comprising three distinct sections, a proximal section extending from the neck portion of the container and connected thereto by a first bend, a distal (curved) section comprising the free end of the neck finish and an intermediate section extending between the proximal section and the distal section and connected thereto by respectively a second bend and a third bend, wherein the proximal section is substantially planar and has a width of at least 0.5 mm measured between the first and second bends.

The terms "bends" and "curls" may be used interchangeably in what follows, as both refer to transitions between other sections (such as the proximal, intermediate and distal section).

In an embodiment, one or more, preferably all, of the sections which are comprised in the neck finish are curved. Preferably, at least the intermediate or the distal sections are curved, more preferably, both the intermediate and distal section are curved.

The metal bottle-shaped container of the invention additionally preferably features the proximal section extending under an angle of 5° to 25° in view of the horizontal in an upright position of the container.

The design of the neck finish of a metal bottle-shaped container of the invention allows for a progressive increase in compression, in both the extend of the compressed area as in the degree of compression, of a regular crown closure seal or liner when applied on a container according to the invention. By increasing the contact area (extend of the contact surface between the neck finish, in particular or predominantly the proximal section thereof, and the seal) between seal and neck finish and by the progressive increase in compression of the liner, a sealing between the crown closure liner and the neck finish is achievable that performs well in terms of on the one hand, air ingress into the bottle—or gas egress out of the bottle—at the interface of neck finish and liner and at the other hand diffusion of gas through the compressed liner. Additionally, by the progressive increase in compression mentioned above, the crown closure can be applied at relative low vertical loads on the bottle allowing a large design freedom of the bottle neck both in material thickness and cross-sectional design.

The first bend preferably has a radius of curvature of between 0.1 and 1.5 mm and defines an angle $\alpha$ between the horizontal and a plane AB wherein the proximal section extends or that extends tangential to a midpoint of said proximal section defined at an outer surface of the proximal section equidistant from the center of curvature of the first and second bends, said angle $\alpha$ ranging between 80 and 110°.

According to a preferred embodiment of a container according to the present invention, a line defined by the centers of curvature of the second and third bends extends under an angle $\beta$ in view of a line defined by the centers of curvature of the first and second bends, the angle $\beta$ ranging between 80 and 110°.

The intermediate section preferably has a radius of curvature of at least 4 mm.

The second bend preferably has a radius of curvature of between 0.4 and 1.0 mm.

The third bend preferably has a radius of curvature of between 0.2 and 1.0 mm and defines an angle $\gamma$ between a line defined by the centers of curvature of the second and third bends and a tangential line at a midpoint of distal (curved) section defined at an outer surface of the distal (curved) section equidistant from the center of curvature of the third bend and the free end of the distal (curved) section, the angle $\gamma$ ranging between 70 and 100°.

Preferably a gap is defined between the free end of the neck finish and the neck portion of the container, the gap having a dimension of less than 0.5 mm.

The neck finish of a metal bottle-shaped container according to the present invention preferably has a height—defined as the perpendicular distance between the plane AB and a plane parallel to AB and tangential to the outer surface of the distal (curved) section—comprised in a range between 3 and 4 mm.

The metal of the container at the neck finish preferably has a mean average thickness of between 0.10 and 0.35 mm.

The present invention further concerns a long-neck bottle-shaped lightweight metal container comprising a shoulder portion and a neck portion, wherein the shoulder portion and neck portion have a total height that amounts to 35% of the height of the total bottle and/or have a total height of 90 mm or more and a vertical load resistance of no more than 226.79618 kg, characterized in that said container is sealed with a pry-off crown cap. Preferably, the bottle comprises a neck finish as identified above and the crown cap comprising a seal or liner positioned between the crown cap and the neck finish.

DETAILED DESCRIPTION OF THE INVENTION

Figure 2:
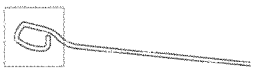
Figure 1:
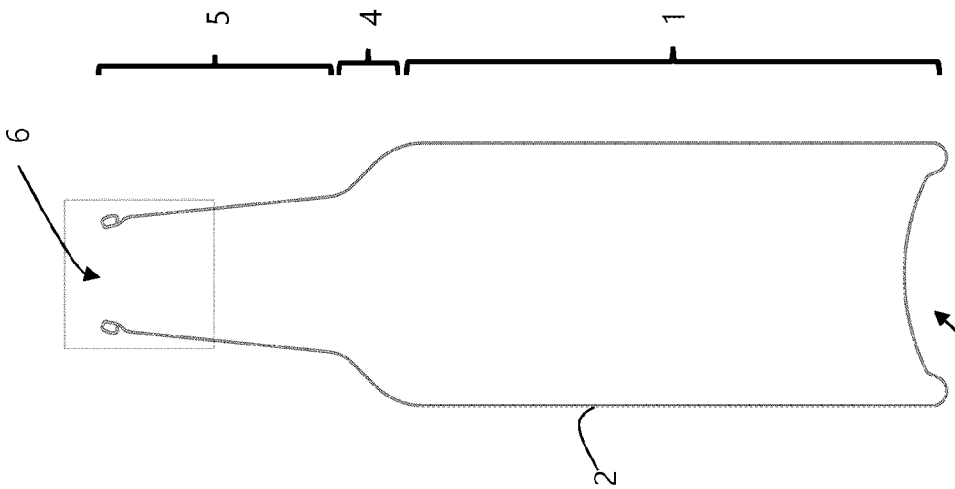
FIG. 1 shows a bottle-shaped container according to the present invention.

FIG. 1 shows a bottle-shaped container, in particular a metal bottle-shaped container of the type known as a short-neck container. The container comprises a body portion 1 comprising a substantially cylindrical wall part 2 extending in a longitudinal direction that at one end is closed by a bottom portion 3 and at the other end seamlessly extends into a shoulder portion 4, wherein the bottle diameter gradually diminishes in the longitudinal direction. The shoulder portion 4 extends seamlessly into a neck portion 5 that defines an access opening of the container. At the opening and as shown in more detail in FIG. 2, the neck portion 5 extends in to a neck finish 6 circumscribing the opening of the container. The opening extending in a plane XY.

Figure 3:
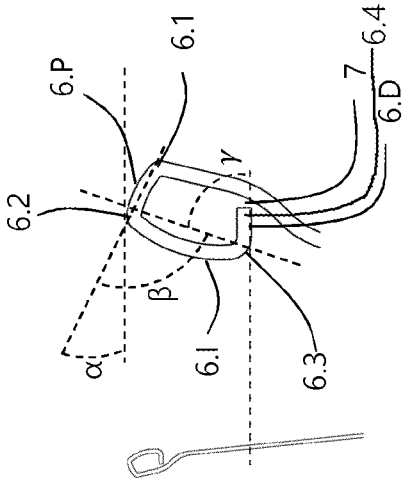
FIGS. 2 & 3 shows in increasing more detail a neck finish of a metal bottle-shaped container in accordance with the present invention.

The neck finish, shown in more detail in FIG. 3, comprises three distinct sections separated from one another by bends. Starting from the neck portion of the container, the neck finish 6 comprises subsequently i) a first bend 6.1, ii) a proximal section 6.P extending substantially under an angle a in view of the XY plane and radially outward from the container, iii) a second bend 6.2, iv) an intermediate section 6.1 extending in a substantially longitudinal direction of the container, from the proximal section 6.P towards the bottom of the container, v) a third bend 6.3, and vi) a distal (curved) section 6.D defining a free end 6.4 of the neck finish.

In accordance with the present invention, the proximal section 6.P is substantially planar, whereby for the sake of the invention, substantially planar is defined as having radius of curvature of at least 4 mm up to a radius of curvature equaling infinity wherein the proximal section is effectively planar. This proximal section preferably extends over a width—measured in a radial direction of the container between the centers of curvature of the first and second bends 6.1 and 6.2—of at least 0.5 mm.

The first bend 6.1 preferably has a radius of curvature of between 0.1 and 1.5 mm and defines the angle $\alpha$ between a (horizontal) plane XY—wherein the container mouth 6 extends—and a plane AB wherein the proximal section 6.P extends or that extends tangential to a midpoint of said proximal section 6.P defined at an outer surface of the proximal section equidistant from the centers of curvature of the first and second bends 6.1 & 6.2, said angle $\alpha$ ranging between 5 and 25°.

The intermediate section 6.1, which extends substantially downward in an upright position of the container, is preferably substantially planar (see definition supra), and preferably extends under an angle $\beta$ in view of the proximal section 6.P, which angle $\beta$ substantially corresponds to the angle between on the one hand, a line defined between the centers of curvature of the second and third bends 6.2 & 6.3 and, on the other hand, a line defined by the centers of curvature of the first and second bends 6.1 & 6.2. The angle $\beta$ preferably ranges between 80 and 110°. The second bend 6.2 preferably has a radius of curvature of between 0.4 and 1.0 mm.

The distal (curved) section 6.D extends in a substantially radial direction of the container, towards the container thereby nearly closing the neck finish, but leaving a gap 7 or spacing between the free end 6.4 of the neck finish and the neck of the container. Such spacing allowing minimal deformation of the neck finish upon application of a crown thereon, without the bend free end 6.4 damaging the neck of the container. The gap 7 or spacing preferably has dimension of less than 0.5 mm.

The third bend 6.3 defines an angle $\gamma$ between a line defined by the centers of curvature of the second and third bends 6.2 & 6.3 and a tangential line at a midpoint of distal (curved) section 6.D defined at an outer surface of the distal (curved) section 6.D equidistant from the center of curvature of the third bend 6.3 and the free end 6.4 of the neck finish, the angle $\gamma$ ranging between 70 and 100°.

The neck finish 6 preferably has a height, defined as the (perpendicular) distance between the plane AB and a plane parallel to AB and tangential to the outer surface of the distal (curved) section 6.D, that ranges between 3 and 4 mm. The mean average thickness of the metal of the container at the neck finish preferably ranges between 0.10 and 0.35 mm, preferably between 0.15 and 0.30 mm.

Figure 5:
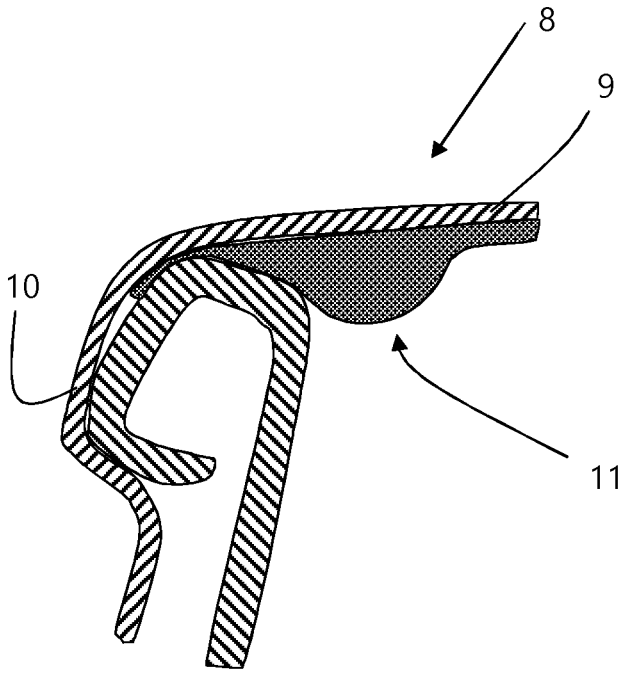
FIG. 5 illustrates a detail of a neck finish with a crown closure crimped thereon.

In FIG. 5, a detail of a crown closure 8 is shown crimped on the container according to the present invention, wherein the crown closure, typically addressed as a pry-off type of crown, comprises a disc-like hood 9 with a peripheral skirt 10. When crimped, the peripheral skirt engages the neck finish 6 of the container over a section comprising the intermediate section 6.1, thereby clamping the mouth of the container. The closure comprises a seal member 11, usually as part of a liner provided on the surface of the hood 9 facing the opening of the container, whereby, with a container according to the present invention, the engagement between seal and container is positioned along the proximal section 6.P close to the opening of the container (inside of the container), wherein the sealing of the container is ensured by a pressurization of the seal in a direction outward of the container. Such position of the engagement between seal and container differs from containers having a rounded curl upper surface, where the seal engagement is situated more distant from the opening from the container (outside of the container) and provides sealing by a pressure directed towards the inside of the container.

As such, the neck finish in accordance with the present invention allows to crown closure on light-weighted C2C bottles using reduced vertical loads of between 90.71847 and 226.79618 kg, preferably between 136.07771 and 158.75733 lbs for standard crowns having a 28 mm outer diameter and/or for bottles having a neck finish diameter of between 20 and 38 mm. The square shape (referring to the nearly straight corners defined by the (curved) sections and the planarity of the neck finish) offers optimized crown deformation at the top radius, tight radius in the bottom of the neck finish to increase clamping force and a flat surface on the top. In fact, the neck finish design in accordance with the present invention allows for applying crown closures by nearly diametrically opposite upward and downward forces exerted on the neck finish of the container rather than on the entire container including the neck and shoulder portions of the container.

Further the design of the neck finish of a metal bottle-shaped container of the invention allows for a progressive increase in compression, in both the extend of the compressed area as in the degree of compression, of a regular crown closure seal or liner when applied on a container according to the invention. By increasing the contact area (extend of the contact surface between the neck finish, in particular or predominantly the proximal section thereof, and the seal) between seal and neck finish and by the progressive increase in compression of the liner, a sealing between the crown closure liner and the neck finish is achievable that performs well in terms of on the one hand, air ingress into the bottle—or gas egress out of the bottle—at the interface of neck finish and liner and at the other hand diffusion of gas through the compressed liner. Additionally, by the progressive increase in compression mentioned above, the crown closure can be applied at relative low vertical loads on the bottle allowing a large design freedom of the bottle neck both in material thickness and cross-sectional design.

Figure 4:
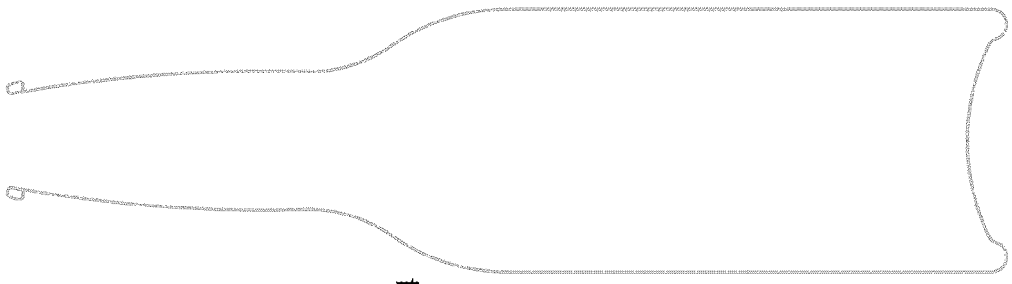
FIG. 4 shows an alternative bottle-shaped container according to the present invention, in particular a long-neck version of a metal bottle-shaped container according to the invention.

The present invention is specifically suitable for long-neck light-weight metal containers such as depicted in FIG. 4, whereby long-neck is defined as bottle shaped containers wherein the sum of the heights of the shoulder portion 4 and the neck portion 5 measures 90 mm or more and/or wherein the sum of the heights of the shoulder portion 4 and the neck portion 5 amount to 35% or more of the total bottle height.

The long-neck bottle-shaped metal container according to the invention may be a lightweight bottle which is defined by having a vertical load resistance of no more than 226.79618 kg.

The invention claimed is:

1. A metal bottle-shaped container comprising a neck portion defining an opening to the container, the neck portion extending into a neck finish configured to receive a crown closure for sealing the opening, the neck finish comprising three distinct sections: a proximal section extending from the neck portion of the container and connected thereto by a first bend, a distal section comprising a free end of the neck finish and an intermediate section extending between the proximal section and the distal section and connected thereto by respectively a second bend and a third bend, wherein the proximal section is substantially planar and has a width of at least 0.5 mm measured between the first and second bends.

2. The metal container according to claim 1, wherein the proximal section extends under an angle of 5° to 25° in view of the horizontal in an upright position of the container.

3. The metal container according to claim 1, the first bend has a radius of curvature of between 0.1 and 1.5 mm.

4. The metal container according to claim 1, wherein a line defined by the centers of curvature of the second and third bends extends under an angle β in view of a line defined by the centers of curvature of the first and second bends, the angle β ranging between 80 and 110°.

5. The metal container according to claim 1, wherein the intermediate section has a radius of curvature of at least 4 mm.

6. The metal container according to claim 1, the second bend having a radius of curvature of between 0.4 and 1.0 mm.

7. The metal container according to claim 1, wherein the third bend defines an angle γ between a line defined by the centers of curvature of the second and third bends and a tangential line at a midpoint of distal section defined at an outer surface of the distal section equidistant from the center of curvature of the third bend section and the free end of the distal section, the angle γ ranging between 70° and 100°.

8. The metal container according to claim 1, the third bend having a radius of curvature of between 0.2 and 1.0 mm.

9. The metal container according to claim 1, wherein a gap is defined between the free end of the neck finish and the neck portion of the container, the gap having a dimension of less than 0.5 mm.

10. The metal container according to claim 1, having a neck finish height, defined as the perpendicular distance between a plane AB wherein the proximal section extends or that extends tangential to a midpoint of said proximal section defined at an outer surface of the proximal section equidistant from the center of curvature of the first and second bends and a plane parallel to AB and tangential to the outer surface of the distal section, the neck finish height comprised in a range between 3 and 4 mm.

11. The metal container according to claim 1, wherein the metal of the container at the neck finish has a mean average thickness of between 0.10 and 0.35 mm.

12. The metal container according to claim 1, sealed off by a crown cap crimped on the bends of the container.

13. The metal container according to claim 12, the crown cap comprising a seal engaging the proximal section of the container.

14. A long-neck bottle-shaped lightweight metal container comprising a shoulder portion and a neck portion, wherein the shoulder portion and neck portion have a total height that amounts to 35% of the height of the total bottle and/or have a total height of 90 mm or more and a vertical load resistance of no more than 226.79618 kg, wherein said container is sealed with a pry-off crown cap, comprising the neck finish as identified in claim 1 and the crown cap comprising a seal or liner positioned between the crown cap and the neck finish.

* * * * *